US006422492B1

(12) United States Patent
Lisson et al.

(10) Patent No.: US 6,422,492 B1
(45) Date of Patent: Jul. 23, 2002

(54) APPARATUS FOR TREATING ION-EXCHANGE RESIN

(75) Inventors: Johann Lisson, Darmstadt; Karl-Heinz Kleinschroth, Mörfelden-Walldorf; Robert Grigat, Frankfurt; Klaus Blinn, Rödermark, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/358,290

(22) Filed: Jul. 21, 1999

Related U.S. Application Data

(63) Continuation of application No. PCT/DE98/00048, filed on Jan. 8, 1998.

(30) Foreign Application Priority Data

Jan. 21, 1997 (DE) ..... 197 01 929

(51) Int. Cl.[7] ..... B02C 19/12

(52) U.S. Cl. ..... 241/21; 241/101.8; 241/261.2; 241/296

(58) Field of Search ..... 241/101.8, 21, 241/261.2, 261.3, 296; 588/20; 976/380

(56) References Cited

U.S. PATENT DOCUMENTS 4,092,337 A * 5/1978 Jager et al.
4,752,298 A * 6/1988 Burglin et al.
5,564,103 A * 10/1996 Gagel

* cited by examiner

*Primary Examiner*—Mark Rosenbaum
(74) *Attorney, Agent, or Firm*—Laurence A. Greenberg; Werner H. Stemer; Ralph E. Locher

(57) ABSTRACT

An apparatus for treating ion-exchange resin includes a disk mill having a plurality of disks including corundum for comminuting the ion-exchange resin. Reliable temporary storage or final storage even of coarse-grained ion-exchange resin from a nuclear plant is made possible by reduction of the swelling capacity.

12 Claims, 1 Drawing Sheet

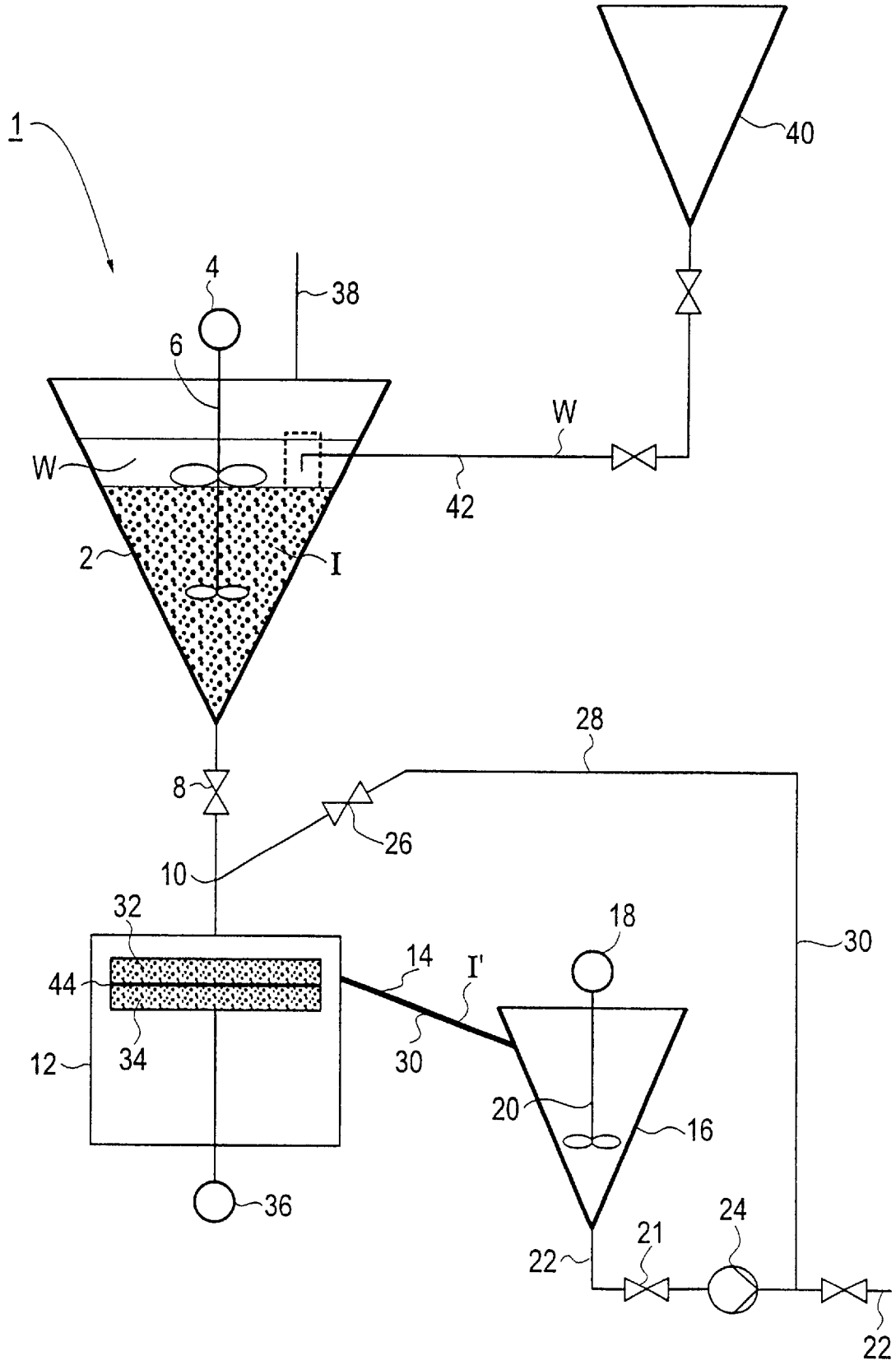
1
40
4
38
6
W
W
42
2
I
28
8
26
10
32
18
30
44
14
I'
12
34
30
20
16
36
24
21
22
22

APPARATUS FOR TREATING ION-EXCHANGE RESIN

CROSS-REFERENCE TO RELATED APPLICATION

This application is a continuation of copending International Application No. PCT/DE98/00048, filed Jan. 8, 1998, which designated the United States.

BACKGROUND OF THE INVENTION

FIELD OF THE INVENTION

The invention relates to an apparatus for treating ion-exchange exchange resin from a nuclear plant in which a mill is provided for comminuting the ion-exchange resin. An apparatus of that type is disclosed, for example, by U.S. Pat. No. 5,564,103.

In a nuclear plant, in particular in a nuclear power plant, wastewater streams or condensate streams are customarily subjected to purification.

In this type of purification, in particular for final purification, ion-exchange resins can be used in bed form (e.g. mixed bed filter) or in the form of precoat layers, especially for deionizing the respective wastewater stream or condensate stream. Depending on the ion type occurring, anionic and/or cationic ion-exchange resins can be used. The respective ion-exchange resin can be used in powder form as powder resin. Alternatively, ion-exchange resin can also be used in the form of small beads (bead resin).

After use, the ion-exchange resins used as purification material or filter material are transferred to a final storage. Fine-grained or pulverulent ion-exchange resins can be subjected here to a chemical or thermal treatment which reduces their swelling capacity. After such reduction of the swelling capacity of the respective ion-exchange resin, incorporation of the ion-exchange resin into a cement matrix or bitumen matrix is feasible, without the matrix being destroyed by swelling of the ion-exchange resins. A pulverulent ion-exchange resin is particularly suitable for final storage in this manner.

In contrast, in the case of a coarse-grained ion-exchange resin or in the case of a bead resin, only a limited reduction in the swelling capacity is achievable by a chemical or thermal treatment. Size reduction or comminution of coarse-grained or bead form ion exchange resin has therefore been desired but found to be difficult in practice, at least in part because the consistency of the resin particles is tough, gummy, a bit clammy. Therefore the particles cannot be ground like grain but have to be torn into pieces. Robust and long lasting apparatus to do this has not been-available. Therefore, these ion-exchange resins are customarily stored temporarily or finally in dewatered or dried form or using a binder. However, in this type of storage, undesirable swelling and thus damage to the ion-exchange resin packaging is still possible in the event of water ingress.

SUMMARY OF THE INVENTION

It is accordingly an object of the invention to provide an apparatus for treating ion-exchange resin which overcomes the above-mentioned disadvantages and makes possible particularly reliable temporary storage or final storage even of coarse-grained ion-exchange resin or of bead resin.

It is a further object of the invention to provide for the incorporation into a cement matrix or bitumen matrix of coarse-grained ion-exchange resin or bead resin by suitable reduction of the swelling capacity of the ion-exchange resin or of the bead resin in a similar manner to the treatment of a fine-grained ion-exchange resin. In order to make possible such a reduction in the swelling capacity of the coarse-grained ion-exchange resin or of the bead resin, the coarse-grained ion-exchange resin or the bead resin should first be comminuted in the manner of a pretreatment.

It is also an object of the invention to provide for this purpose a suitable comminution apparatus.

With the foregoing and other objects in view, there is provided according to the invention an apparatus for treating ion-exchange resin from a nuclear plant in which a mill is provided for comminuting the ion-exchange resin in which the mill is a disk mill having as grinding elements a plurality of disks including corundum.

The comminution apparatus provided is a disk mill which has as grinding elements a number of disks including corundum. In this case, the grinding elements provided are at least one stationary stator disk including corundum and at least one rotor disk including corundum which rotates relative to a stator disk. A rotor disk is preferably a horizontally rotating disk so that the particles to be torn do not fall off too easily.

In an adjustable gap provided between the stator disk and the rotor disk, the comminution of the ion-exchange resin can be performed by shear forces and cutting forces. In particular, due to the physical properties of the ion-exchange resin, that is to say due to its elasticity, the use of a disk mill with disks including corundum has proved to be particularly effective in the comminution of the ion-exchange resin.

The purpose of the mill is to tear the tough and gummy ion-exchange-particles apart. Therefore the disks in the mill have a very rough surface with corundum particles on the surface having sharp, cutting, tapering edges and points which grip the ion exchange resin particles and tear and cut them apart. Thus, the process in the disk mill with disks including corundum is not a grinding process but rather a cutting and tearing process.

For that reason the hardness of the surface of the disks is not the most relevant. The following properties are more important:

1. The surface of the disks including corundum has to be rough. The corundum surface is like sand paper, where sand or sanding particles are glued on a solid base material. The remainder of the disk can be corundum or any other suitable base material.

2a. The particles of the surface have to be rather large, with a diameter of about 1 mm to 2 mm. That means that the particles have to be made from a material which affords very firm, strong, non-brittle particles of that size. Silicon carbide for example is extremely hard, but silicon carbide particles are smaller, are not available in that large size and tend to break in the milling process. Corundum particles, in contrast, suit perfectly for robust large particles.

2b. A second reason for large corundum particles is that otherwise disks would be easily gummed up and covered with the tough and gummy ion exchange resin particles. With a smooth surface this is easily the case.

3. The particles should have sharp and cutting edges and points. Broken corundum has such edges and points naturally. It is like broken glass, only harder and tougher.

Accordingly, any material with the above described properties can be taken for being glued on the disks of the disk mill according to this invention. Corundum has these properties, is common, cheap and easy to handle.

Disks including corundum having the mentioned properties are commercially available, as well as disk mills with such disks.

In accordance with a particularly preferred feature of the invention, for a particularly reliable treatment of the ion-exchange resin, the disk mill is advantageously connected into a recirculation circuit of the ion-exchange resin. Thus repeated passage of the ion-exchange resin through the disk mill is possible, with more intensive comminution being achievable from passage to passage in particular by variation of the gap between the grinding elements of the disk mill. The ion-exchange resin is pumpable in a suspension after a first comminution and thus can be recirculated, although coarse-grained ion-exchange resin or bead resin customarily sediments.

The advantages achieved by the invention are, in particular, that by the use of a disk mill with disks including corundum in the treatment of an ion-exchange resin from a nuclear plant, comminution of the ion-exchange resin is possible using particularly measures. The comminution can be carried out in this case, in particular after a plurality of passages of the ion-exchange resin through the disk mill, up to a particle size of the ion-exchange resin of less than 200$\mu$. The swelling capacity of an ion-exchange resin treated in thus manner can be reduced by means of a thermal or chemical treatment.

Ion-exchange resin formerly in bead form which has been treated in this manner can thus be fed to a particularly suitable temporary storage or final storage, for example by incorporation into a cement matrix or bitumen matrix.

Other features which are considered as characteristic for the invention are set forth in the appended claims.

Although the invention is illustrated and described herein as embodied in an apparatus for treating ion-exchange resin, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The FIGURE of the drawing diagrammatically shows an apparatus according to the invention for comminuting ion-exchange resin.

DESCRIPTION OF THE PREFERRED EMBODIMENTS

Referring now to the single figure of the drawing in details, there is seen an apparatus 1 according to the figure is provided for treating ion-exchange resin I from a non-illustrated nuclear plant. The apparatus 1 includes a receiving vessel 2 provided for receiving the ion-exchange resin I. The receiving vessel 2 has an agitator 6 which can be driven by a motor 4. On the outlet side, the receiving vessel 2 is connected via a line 10, which can be shut off by a valve 8, to a disk mill 12. The disk mill 12 is itself connected on the outlet side via a line 14 to a collection vessel 16 which has an agitator 20 which can be driven via a motor 18. The collection vessel 16 is connected on the outlet side to a line 22, which can be shut by a valve 21, in which line is connected a pump 24. The line 22 is connected in a manner which is not shown in more detail to an apparatus for further treatment of the ion-exchange resin I.

In the pumping direction, downstream of the pump 24 a line section 28, which can be shut off by a valve 26, branches off from the line 22, which line section is connected to the line 10 provided between the receiving vessel 2 and the disk mill 12. In other words, the disk mill 12 is connected in a recirculation circuit 30 formed by the line 14, the collection vessel 16, the line 22, the pump 24, the line section 28 and the line 10.

The disk mill 12 includes, as first grinding element 32, a stator disk and, as second grinding element 34, a rotor disk which can be driven via a motor 36. The grinding elements 32, 34 are constructed as corundum disks.

When the apparatus 1 is operated, the ion-exchange resin I is fed via a feed line 38 to the receiving vessel 2. In the receiving vessel 2, the ion-exchange resin I is stirred as resin/water mixture. For this purpose, water W is fed from a water vessel 40 via a feed line 42 to the receiving vessel 2. The apparatus can be operated at any convenient temperature between the freezing point and the boiling point of water at the ambient pressure; the latter is usually atmospheric but can be superatmospheric or subatmospheric as desired.

The ion-exchange resin I is fed via the line 10 to the disk mill 12. In a gap 44 between the grinding elements 32, 34 of the disk mill 12, the ion-exchange resin I is comminuted owing to shear forces and cutting forces. After its comminution, the ion-exchange resin I' passes into the collection vessel 16.

After at least one passage through the disk mill 12, the comminuted ion-exchange resin I' is pumpable in a suspension and can thus be fed by the pump 24 via the recirculation circuit 30 to the disk mill 12 for a renewed passage. By adjustment of the width of the gap 44, on a further passage through the disk mill 12 a more extensive comminution is possible. The comminution of the ion-exchange resin I is carried out further here by repeated passage through the disk mill 12 until the particle size of the ion-exchange resin I' falls below a predetermined limiting value of, for example, about 200 $\mu$m. As soon as this is the case, the comminuted ion-exchange resin I' is transferred via line 22 for further processing. There, for example, a thermal and/or a chemical treatment can be provided for reducing the swelling capacity of the comminuted ion-exchange resin I'. In particular, in this case, treatment of the comminuted ion-exchange resin I'is possible in a similar manner to a treatment of a fine-grained ion-exchange resin. Finally, the comminuted ion-exchange resin I' can be incorporated into a cement matrix or a bitumen matrix.

We claim:

1. An apparatus adapted for treating ion-exchange resin from a nuclear plant, comprising a receiving vessel containing used ion-exchange resin, a line connected to said receiving vessel, a disk mill connected to said line for comminuting ion-exchange resin, said disk mill comprising at least one stationary stator disk comprising corundum and at least one rotor disk comprising corundum rotatable relative to said at least one stator disk, another line connected to said disk mill, and a collection vessel connected to said other line, and wherein at least one of said receiving vessel and said collection vessel includes an agitator.

2. The apparatus according to claim 1, wherein at least one rotor disk is horizontally rotatable.

3. The apparatus according to claim 1, wherein said disks have a rough surface, which is made of particles with a diameter of 1 to 2 millimeters.

4. An apparatus adapted for treating ion-exchange resin from a nuclear plant, comprising a receiving vessel containing used ion-exchange resin, a line connected to said receiving vessel, a disk mill connected to said line for comminuting ion-exchange resin, said disk mill comprising at least one stationary stator disk comprising corundum and at least one rotor disk comprising corundum rotatable relative to said at least one stator disk, another line connected to said disk mill, and a collection vessel connected to said other line, wherein said disk mill is connected in a recirculation circuit for a suspension of the ion-exchange resin, to carry out comminution after a plurality of passages of the resin through said disk mill to a particle size of the resin of less than 200 $\mu$m.

5. The apparatus according to claim 4, wherein said recirculation circuit includes a line from an outlet side of said disk mill to an agitated vessel, a line from an outlet side of said vessel to a pump, and a line from said pump to an inlet side of said disk mill.

6. A method for comminuting ion-exchange resin from a nuclear plant, comprising the steps of supplying used ion-exchange resin to a receiving vessel, transferring the used ion-exchange resin through a line connecting the receiving vessel to a disk mill comprising at least one stationary stator disk comprising corundum and at least one rotor disk comprising corundum rotatable relative to a stator disk, rotating the rotatable disk relative to the stator disk, and transferring comminuted ion exchange resin to a collection vessel through a line connecting the disk mill to the collection vessel.

7. The process of claim 6, wherein at least one rotor disk is horizontally rotatable.

8. The process of claims 6, wherein the disks have a rough surface, which is made of particles with a diameter of 1 to 2 millimeters.

9. The process of claim 6, wherein the resin in least one of the receiving vessel and the collection vessel is agitated.

10. The process of claim 6, wherein a suspension of the ion-exchange resin is recirculated for a plurality of passages of the resin through the disk mill to a particle size of less than 200 $\mu$m.

11. The process of claim 10, wherein the resin is passed through a recirculation circuit comprising a line from the outlet side of the disk mill to an agitated vessel, a line from the outlet side of the vessel to a pump, and a line from the pump to the inlet side of the disk mill.

12. In an apparatus for treating ion-exchange resin from a nuclear plant, comprising a receiving vessel containing used ion-exchange resin, a grinder, a collection vessel and lines connecting said grinder to said receiving vessel, and said collection vessel, the improvement wherein said grinder is a disk mill for comminuting ion-exchange resin, said disk mill comprising at least one stationary stator disk comprising and at least one rotor disk comprising corundum rotatable relative to a stator disk.

* * * * *